US007921993B1

(12) United States Patent
Zammit

(10) Patent No.: US 7,921,993 B1
(45) Date of Patent: Apr. 12, 2011

(54) FLUID COMPONENT SEPARATION SYSTEM

(76) Inventor: James W. Zammit, Mississauga (CA)

( * ) Notice: Subject to any disclaimer, the term of this patent is extended or adjusted under 35 U.S.C. 154(b) by 0 days.

(21) Appl. No.: 12/561,355

(22) Filed: Sep. 17, 2009

(51) Int. Cl.
*B65D 25/08* (2006.01)

(52) U.S. Cl. ..... 206/222; 206/219; 215/DIG. 8

(58) Field of Classification Search ..... 206/219, 206/222, 268; 222/80, 83, 81, 87; 215/DIG. 8
See application file for complete search history.

(56) References Cited

U.S. PATENT DOCUMENTS

| | | | | |
|---|---|---|---|---|
| 2,631,521 | A * | 3/1953 | Atkins, Jr. | 99/275 |
| 3,156,369 | A * | 11/1964 | Bowes et al. | 206/222 |
| 3,347,410 | A * | 10/1967 | Schwartzman | 222/80 |
| 4,903,865 | A * | 2/1990 | Janowitz | 222/83.5 |
| D337,273 | S | 7/1993 | Thatcher | |
| 5,543,097 | A * | 8/1996 | Fang | 264/102 |
| 5,772,017 | A | 6/1998 | Kang | |
| 6,786,330 | B2 | 9/2004 | Mollstam et al. | |
| 6,843,368 | B1 | 1/2005 | Frutin | |
| 6,962,254 | B2 * | 11/2005 | Spector | 206/222 |
| 7,347,322 | B2 | 3/2008 | Cho | |
| 2003/0213709 | A1 * | 11/2003 | Gibler et al. | 206/219 |
| 2005/0263414 | A1 | 12/2005 | Harilela et al. | |
| 2007/0045134 | A1 * | 3/2007 | Dvorak et al. | 206/222 |
| 2008/0093326 | A1 * | 4/2008 | Cho | 215/228 |
| 2008/0116086 | A1 | 5/2008 | Hung | |

* cited by examiner

*Primary Examiner* — David T Fidei

(57) ABSTRACT

A fluid component separation system includes a container that has an upper end comprising a threaded neck. The container has a first fluid therein. A housing has a top wall and a perimeter wall. The perimeter wall has a lower section that includes the bottom edge. An inner surface of the lower section is threaded and is threadably coupled to the threaded neck. A membrane is mounted in the housing and divides the lower section from an upper section of the housing. The upper section has a second fluid therein. A shaft has a top end and a bottom end. The shaft extends through the top wall and the top end is positioned above the top wall. The bottom end is pointed. The shaft is extendable downwardly through the membrane to pierce the membrane and empty the second fluid into the first fluid.

5 Claims, 6 Drawing Sheets

FLUID COMPONENT SEPARATION SYSTEM

BACKGROUND OF THE DISCLOSURE

Field of the Disclosure

The disclosure relates to fluid separating and mixing devices and more particularly pertains to a new fluid separating and mixing device for allowing two fluids to be retained in a separate state from each other but which may be easily mixed when desired.

SUMMARY OF THE DISCLOSURE

An embodiment of the disclosure meets the needs presented above by generally comprising a container that has an upper end comprising a threaded neck. The container has a first fluid therein. A housing has a top wall and a perimeter wall that is attached to and extends downwardly from the top wall. The perimeter wall has a bottom edge. The perimeter wall has a lower section that includes the bottom edge. An inner surface of the lower section is threaded and is threadably coupled to the threaded neck. A membrane is mounted in the housing and divides the lower section from an upper section of the housing. The upper section has a second fluid therein. A shaft has a top end and a bottom end. The shaft extends through the top wall and the top end is positioned above the top wall. The bottom end is pointed. The shaft is extendable downwardly through the membrane to pierce the membrane and empty the second fluid into the first fluid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
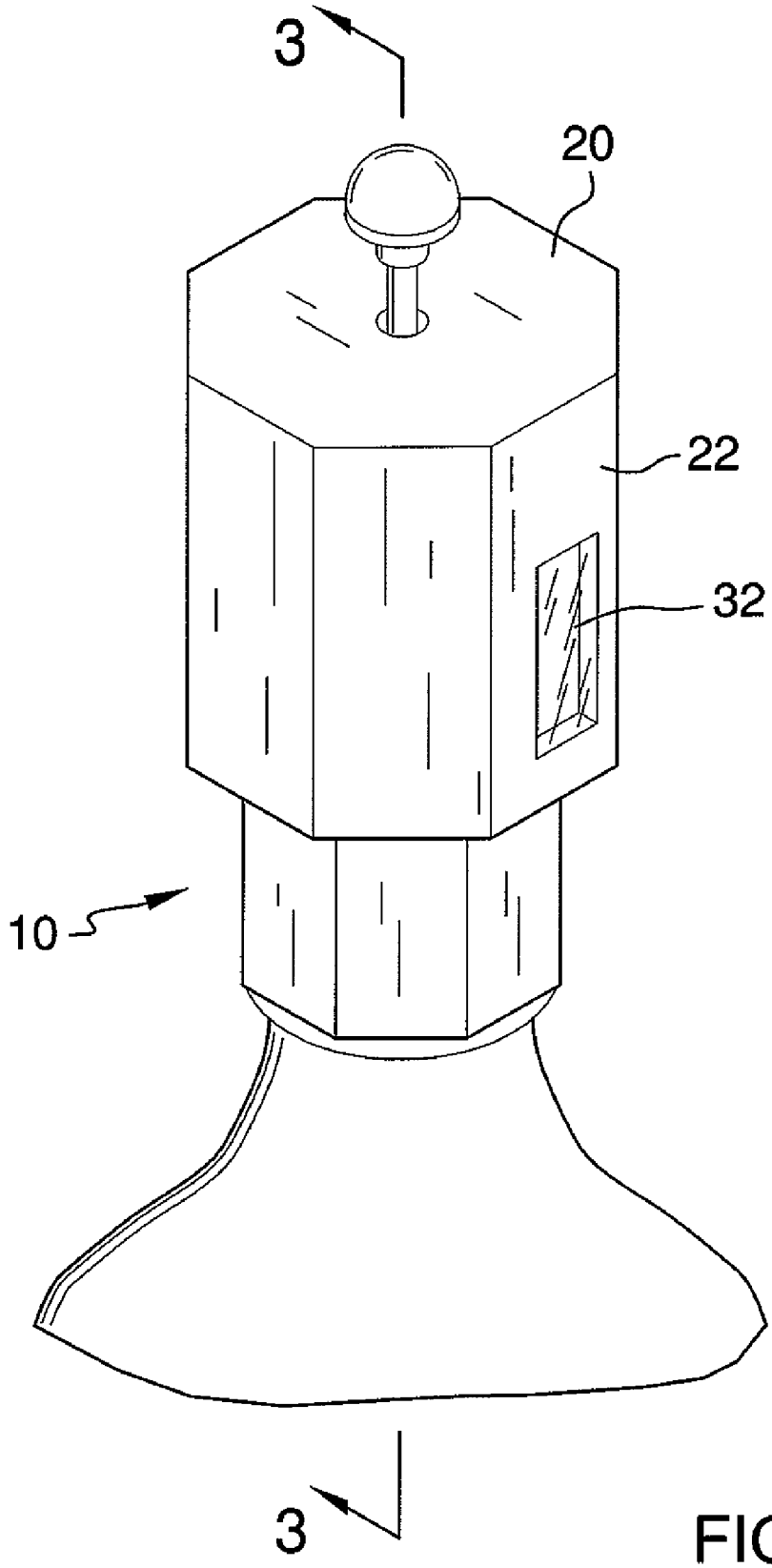
FIG. 1 is a broken front perspective view of a fluid component separation system according to an embodiment of the disclosure.
Figure 2:
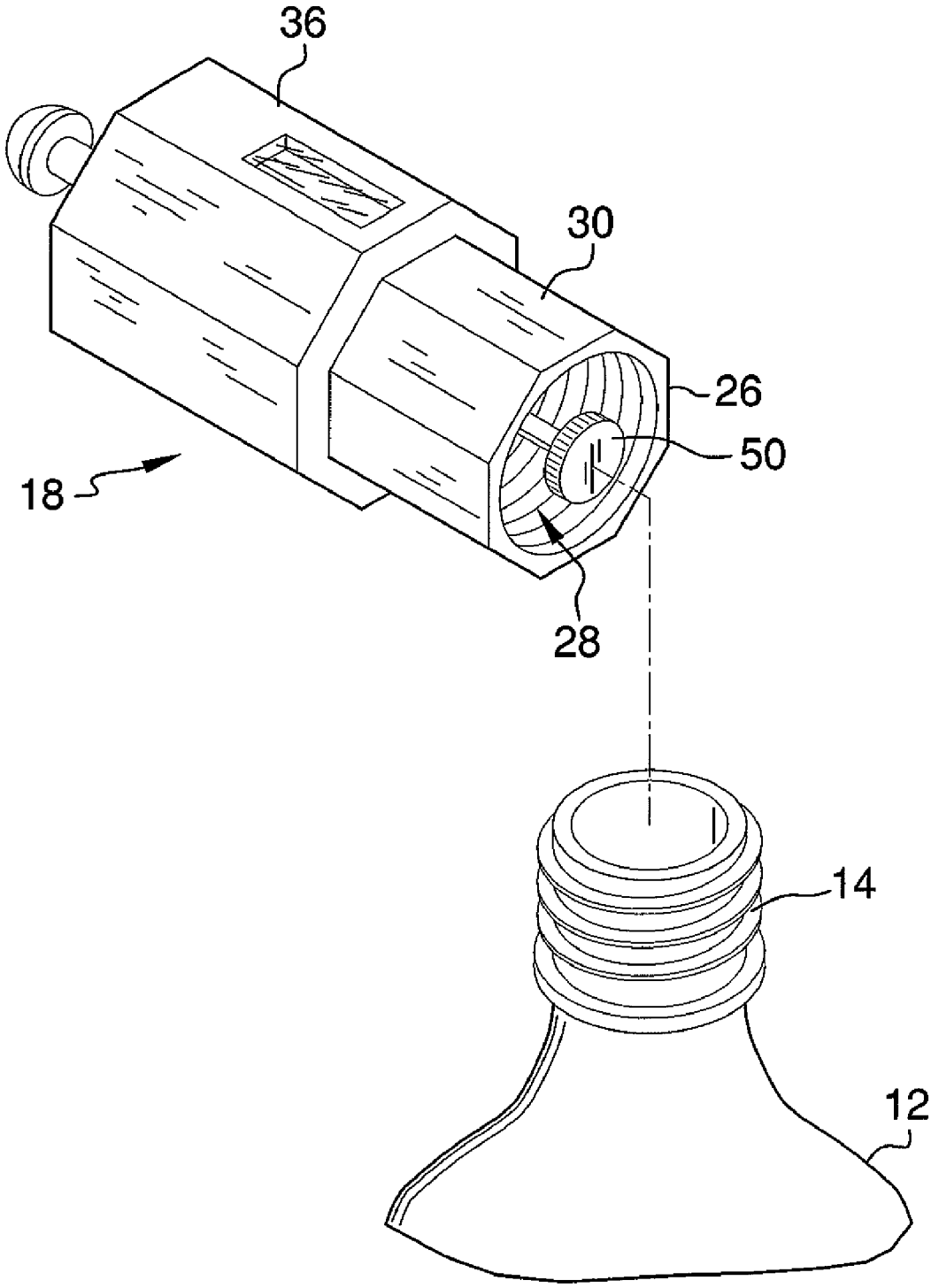
FIG. 2 is an exploded front perspective view of an embodiment of the disclosure.
Figure 3A:
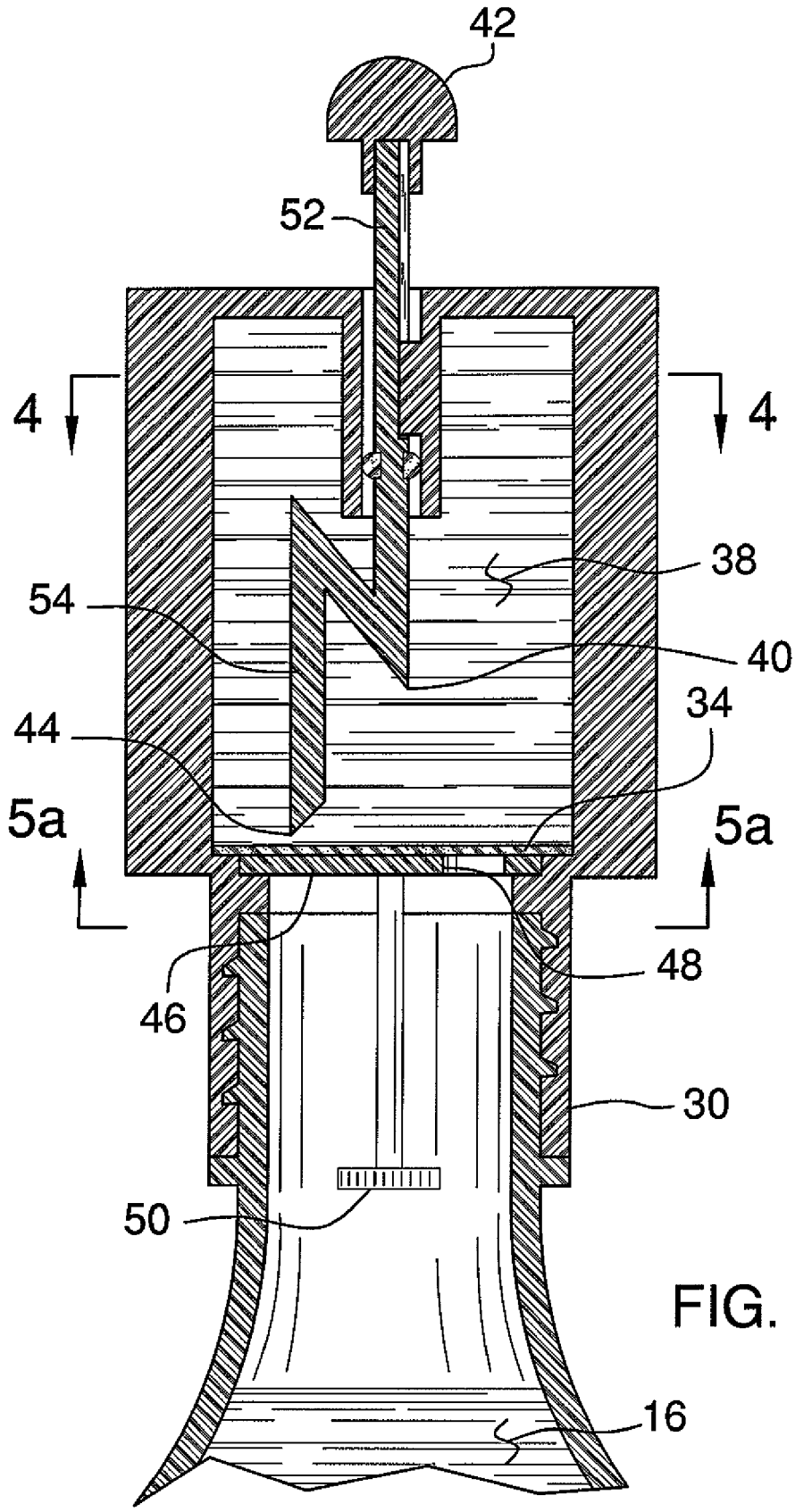
FIG. 3*a* is a cross-sectional view of an embodiment of the disclosure taken along line 3-3 of FIG. 1 with a membrane in a non-pierced state.
Figure 3B:
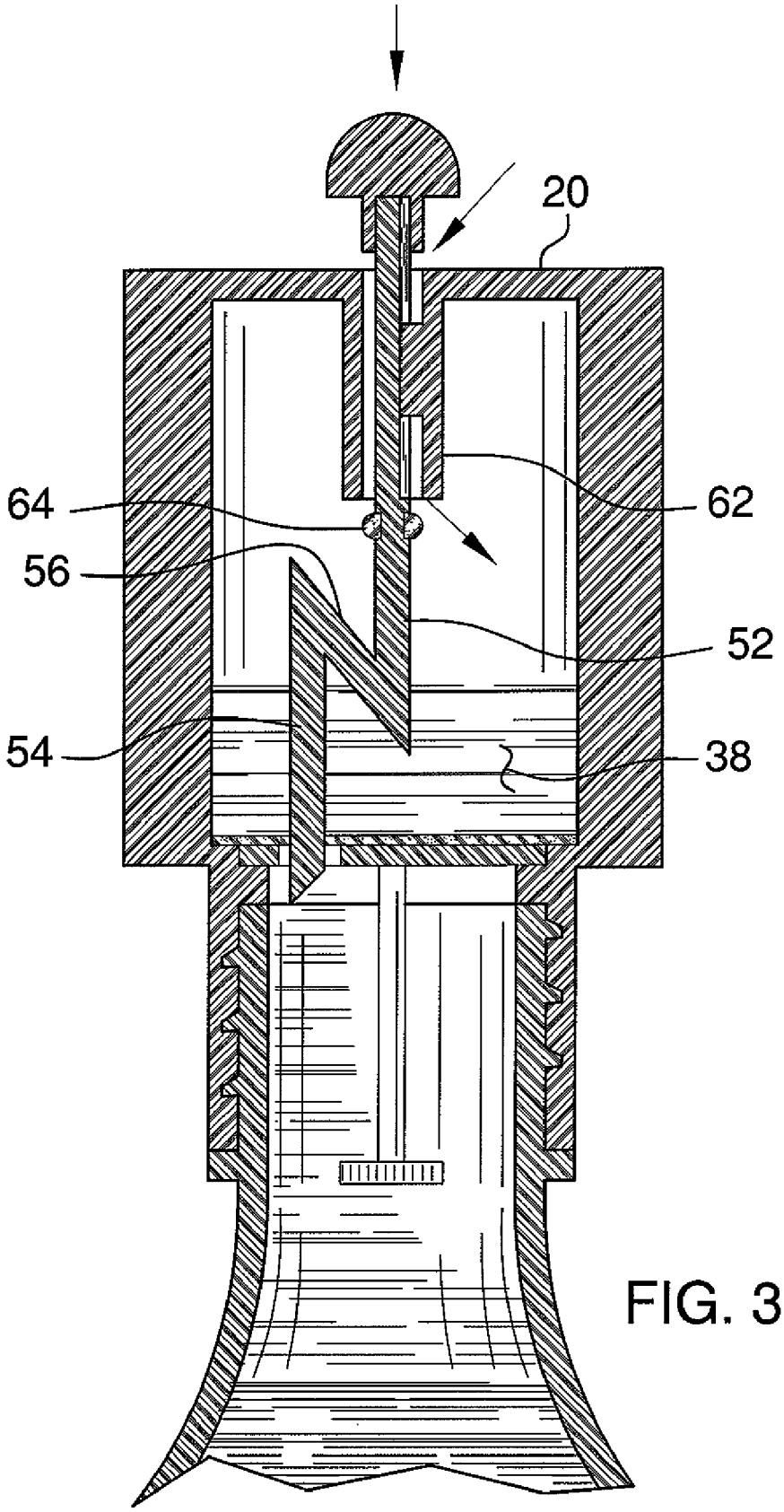
FIG. 3*b* is a cross-sectional view of an embodiment of the disclosure taken along line 3-3 of FIG. 1 with the membrane in a pierced state.
Figure 3C:
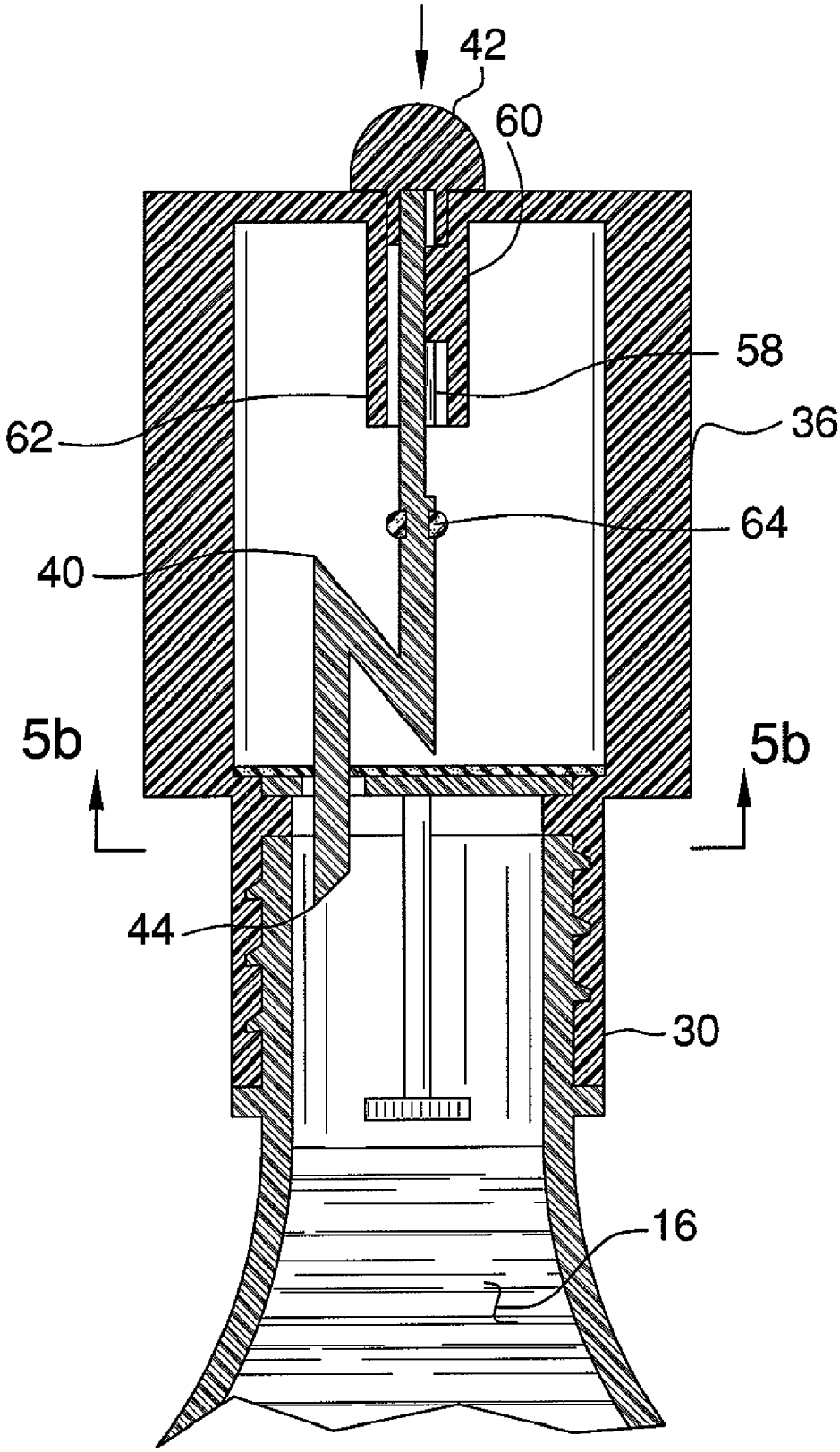
FIG. 3*c* is a cross-sectional view of an embodiment of the disclosure taken along line 3-3 of FIG. 1.
Figure 4:
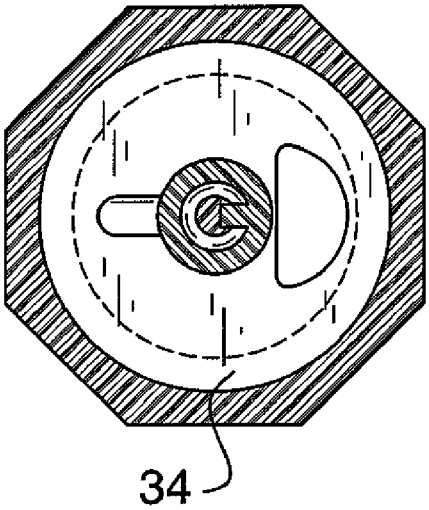
FIG. 4 is a cross-sectional view of an embodiment of the disclosure taken along 4-4 of FIG. 3*a*.
Figure 5A:
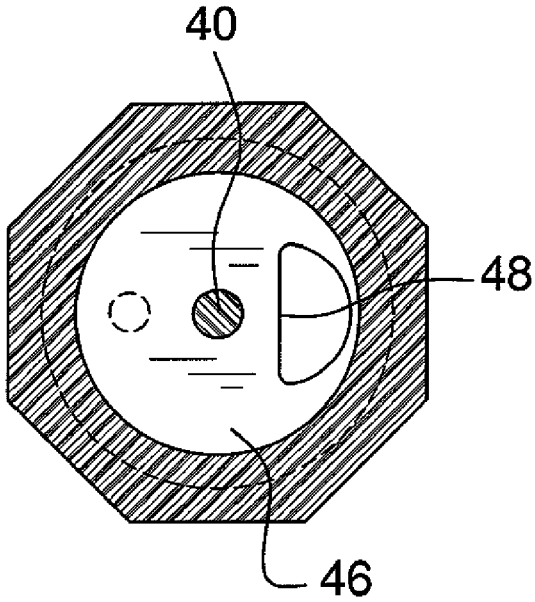
FIG. 5*a* is a cross-sectional view of an embodiment of the disclosure taken along the line 5*a*-5*a* of FIG. 3*a*.
Figure 5B:
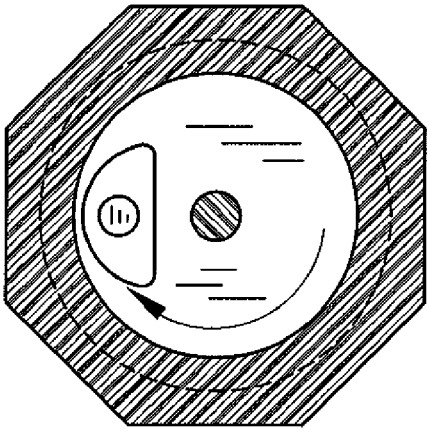
FIG. 5*b* is a cross-sectional view of an embodiment of the disclosure taken along the line 5*b*-5*b* of FIG. 3*c*.

With reference now to the drawings, and in particular to FIGS. 1 through 5 thereof, a new fluid separating and mixing device embodying the principles and concepts of an embodiment of the disclosure and generally designated by the reference numeral 10 will be described.

As best illustrated in FIGS. 1 through 5, the fluid component separation system 10 generally comprises a container 12 that has an upper end comprising a threaded neck 14. The container 12 has a first fluid 16 therein. The first fluid 16 may be a flavored fluid or may include water which is which is not carbonated. The container 12 is shown in broken form but may comprise any conventional container having a bottom wall opposite the neck 14.

A housing 18 has a top wall 20 and a perimeter wall 22 is attached to and extends downwardly from the top wall 20. The perimeter wall 22 has a bottom edge 26 that forms a receiving aperture 28 extending into the housing 18. The perimeter wall 22 has a lower section 30 that includes the bottom edge 26. An inner surface of the lower section 30 is threaded and is threadably coupled to the threaded neck 14. The perimeter wall 22 may have a window 32 therein for viewing the interior of the housing 18.

A membrane 34 is mounted in the housing 18 and divides the lower section 30 from an upper section 36 of the housing 18. The membrane 34 may be comprised of a pliable plastic material. The upper section 36 has a second fluid 38 therein. The second fluid 38 may include a concentrated flavoring, an alcoholic beverage or any other fluid which a person would like to mix with the first fluid 16.

A shaft 40 has a top end 42 and a bottom end 44. The shaft 40 extends through the top wall 20 and the top end 42 is positioned above the top wall 20. The bottom end 44 is pointed. The shaft 40 is extendable downwardly through the membrane 34 to pierce the membrane 34 and empty the second fluid 38 into the first fluid 16. A lower wall 46 is mounted rotatably mounted in the lower section 30 and is positioned between the membrane 34 and the bottom edge 26. The lower wall 46 abuts the membrane 34. The lower wall 46 has an opening 48 extending therethrough that is spaced from a center area of the lower wall 46. A grip 50 is attached to the lower wall 46 to facilitate rotation of the lower wall 46.

The shaft 40 includes a first section 52 extending through a central area of the top wall 20 and a second section 54 including the bottom end 44. The first section 52 is offset from the second section 54 to allow the bottom end 44 to be extended through the opening 48 when the opening 48 is aligned with the bottom end 44. This may be accomplished by the first 52 and second 54 sections having each having a longitudinal axis being orientated parallel to each other and being spaced from each other. An arm 56 extends between and attaches together the first 52 and second 54 sections. The first section 52 may include a tab 58 that is positioned within a female coupler 60 which prevents the shaft 40 from rotating with respect to the housing 18.

A sleeve 62 is attached to bottom surface of the top wall 20 and the shaft extends through the sleeve 62. A seal 64 is mounted on the shaft 40 and is positioned in the sleeve 62 to prevent air from entering the upper section 36 through the top wall 20 when the bottom end 44 is positioned within the upper section 36. The seal 64 is positioned below the sleeve 62 to allow air to enter the upper section 36 through the top wall 20 when the bottom end 44 is extended through the membrane 34.

In use, the system 10 allows a person to selectively add a second fluid to a first one when desired. It also allows a person to use the same container 12 but selectively attach housings 18 having different second fluids therein.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A fluid separation assembly to allow selective mixing of two fluids, said assembly comprising:

a container having an upper end comprising a threaded neck, said container having a first fluid therein;

a housing having a top wall and a perimeter wall being attached to and extending downwardly from said top wall, said perimeter wall having a bottom edge, said perimeter wall including a lower section including said bottom edge, an inner surface of said lower section being threaded and being threadably coupled to said threaded neck;

a membrane being mounted in said housing and dividing said lower section from an upper section of said housing, said upper section having a second fluid therein;

a shaft having a top end and a bottom end, said shaft extending through said top wall and said top end being positioned above said top wall, said bottom end being pointed, said shaft being extendable downwardly through said membrane to pierce said membrane and empty said second fluid into said first fluid; and a lower wall being mounted rotatably mounted in said lower section and being positioned between said membrane and said bottom edge, said lower wall abutting said membrane, said lower wall having an opening extending therethrough being spaced from a center area of said lower wall, said shaft including a first section extending through a central area of said top wall and a second section including said bottom end, said first section being offset from said second section to allow said bottom end to be extended through said opening when said aligned with said bottom end.

2. The assembly according to claim 1, further including a grip being attached to said lower wall to facilitate rotation of said lower wall.

3. The assembly according to claim 1, further including:

a sleeve being attached to bottom surface of said top wall, said shaft extending through said sleeve; and a seal being mounted on said shaft, said seal being positioned in said sleeve to prevent air from entering said upper section when said bottom end is positioned within said upper section, said seal being positioned below said sleeve to allow air to enter said upper section when said bottom end is extended through said membrane.

4. A fluid separation assembly to allow selective mixing of two fluids, said assembly comprising:

a container having an upper end comprising a threaded neck, said container having a first fluid therein;

a housing having a top wall and a perimeter wall being attached to and extending downwardly from said top wall, said perimeter wall having a bottom edge, said perimeter wall including a lower section including said bottom edge, an inner surface of said lower section being threaded and being threadably coupled to said threaded neck;

a membrane being mounted in said housing and dividing said lower section from an upper section of said housing, said upper section having a second fluid therein;

a shaft having a top end and a bottom end, said shaft extending through said top wall and said top end being positioned above said top wall, said bottom end being pointed, said shaft being extendable downwardly through said membrane to pierce said membrane and empty said second fluid into said first fluid;

a lower wall being mounted rotatably mounted in said lower section and being positioned between said membrane and said bottom edge, said lower wall abutting said membrane, said lower wall having an opening extending therethrough being spaced from a center area of said lower wall, said shaft including a first section extending through a central area of said top wall and a second section including said bottom end, said first section being offset from said second section to allow said bottom end to be extended through said opening when said opening is aligned with said bottom end;

a grip being attached to said lower wall to facilitate rotation of said lower wall;

a sleeve being attached to bottom surface of said top wall, said shaft extending through said sleeve; and a seal being mounted on said shaft, said seal being positioned in said sleeve to prevent air from entering said upper section when said bottom end is positioned within said upper section, said seal being positioned below said sleeve to allow air to enter said upper section when said bottom end is extended through said membrane.

5. A fluid separation assembly to allow selective mixing of two fluids, said assembly comprising:

a container having an upper end comprising a threaded neck, said container having a first fluid therein;

a housing having a top wall and a perimeter wall being attached to and extending downwardly from said top wall, said perimeter wall having a bottom edge, said perimeter wall including a lower section including said bottom edge, an inner surface of said lower section being threaded and being threadably coupled to said threaded neck;

a membrane being mounted in said housing and dividing said lower section from an upper section of said housing, said upper section having a second fluid therein;

a shaft having a top end and a bottom end, said shaft extending through said top wall and said top end being positioned above said top wall, said bottom end being pointed, said shaft being extendable downwardly through said membrane to pierce said membrane and empty said second fluid into said first fluid;

a sleeve being attached to bottom surface of said top wall, said shaft extending through said sleeve; and a seal being mounted on said shaft, said seal being positioned in said sleeve to prevent air from entering said upper section when said bottom end is positioned within said upper section, said seal being positioned below said sleeve to allow air to enter said upper section when said bottom end is extended through said membrane.

* * * * *